US006280256B1

(12) United States Patent
Belopolsky et al.

(10) Patent No.: US 6,280,256 B1
(45) Date of Patent: Aug. 28, 2001

(54) ELECTRICAL CONNECTOR FOR REDUCING ELECTRICAL CROSSTALK AND COMMON MODE ELECTROMAGNETIC INTERFERENCE

(75) Inventors: Yakov Belopolsky, Harrisburg; Lee W. Potteiger, Lewisberry, both of PA (US)

(73) Assignee: BergTechnology, Inc., Reno, NV (US)

( * ) Notice: Subject to any disclaimer, the term of this patent is extended or adjusted under 35 U.S.C. 154(b) by 0 days.

(21) Appl. No.: 09/285,106

(22) Filed: Apr. 1, 1999

(51) Int. Cl.[7] ..... H01R 24/00; H01R 13/73
(52) U.S. Cl. ..... 439/676; 439/941
(58) Field of Search ..... 439/676, 941, 439/344, 188, 638; 333/1, 12

(56) References Cited

U.S. PATENT DOCUMENTS

| | | | | |
|---|---|---|---|---|
| 4,717,217 | * | 1/1988 | Bogese, II | 439/83 |
| 5,186,647 | | 2/1993 | Denkmann et al. | 439/395 |
| 5,599,209 | | 2/1997 | Belopolsky | 439/676 |
| 5,639,266 | | 6/1997 | Patel | 439/676 |
| 5,687,418 | | 11/1997 | Earle et al. | 396/602 |
| 5,759,070 | | 6/1998 | Belopolsky | 439/676 |
| 5,791,942 | | 8/1998 | Patel | 439/637 |

* cited by examiner

*Primary Examiner*—Brian Sircus
*Assistant Examiner*—Chandrika Prasad
(74) *Attorney, Agent, or Firm*—Woodcock Washburn Kurtz Mackiewicz & Norris LLP

(57) ABSTRACT

Inserts for use in fabricating modular jack connectors. The inserts include conductors having a rectangular cross section. A first insert includes a plurality of groups of conductive leads that extend across a top wall in first and second common planes toward a front end. A first group of leads form a terminal edge by extending toward the rear end of the first insert in a first common oblique plane. A second group extends angularly toward the front end from the second common plane in a second common oblique plane to form a second terminal edge which extends beyond the first terminal edge. A third group may be provided that extend across portions of the top wall in both the first and second common planes. The first and second oblique planes intersect to form a first contact area. A second insert includes a plurality of groups of conductive leads that extend across a top wall in third and fourth common planes. A third group forms a terminal edge by extending toward the rear end of the second insert in a third common oblique plane. A fourth group extends angularly from the fourth common plane toward the front end in a fourth common oblique plane to form a fourth terminal edge which extends beyond the third terminal edge. The third and fourth oblique planes intersect to form a second contact area.

32 Claims, 12 Drawing Sheets

46
64
72
SECTION A-A
Plane A
Plane B 48
70
71
SECTION B-B 50
71
SECTION C-C 52
64
SECTION D-D 71
54
SECTION E-E
Plane A
Plane B 36
64
SECTION F-F 70
71
54
SECTION G-G 60
64
SECTION H-H

SECTION D-D

SECTION E-E

SECTION F-F

SECTION G-G

SECTION H-H

ELECTRICAL CONNECTOR FOR REDUCING ELECTRICAL CROSSTALK AND COMMON MODE ELECTROMAGNETIC INTERFERENCE

FIELD OF THE INVENTION

The present invention relates to electrical connectors and, more particularly, to receptacles for modular jacks for use in telecommunications equipment.

BACKGROUND OF THE INVENTION

Modular jacks for connecting telecommunications equipment are used for two broad categories of signal transmission: analog (voice) and digital (data) transmission. While these categories overlap somewhat since digital systems may be used for voice transmission, there is a significant difference in the data rates transmitted by each type of system. A low speed system ordinarily transmits at data rates from about 10 to 16 megabits per second (Mbps), while a high speed system transmits at data rates of 155 Mbps or higher. Often, high speed installations are based on asynchronous transfer mode transmission and utilize shielded and unshielded twisted pair cables.

With recent increases in the speed of data transmission, requirements for reduction or elimination of crosstalk have become important for electrical connectors. Crosstalk is a phenomena that occurs when a part of the electromagnetic energy transmitted through one of multiple conductors in a connector causes electrical currents in the other conductors. Another problem is common mode electromagnetic interference or noise. Such common mode interference is often most severe in conductors having the same length, and occurs when a parasitic signal induced by electrostatic discharge (ESD), lightning or simultaneous switching of semiconductor gates arrives in an adjacent electrical node through multiple conductors at the same time.

Another requirement driving telecommunication connector design is that the telecommunications industry has reached a high degree of standardization in modular jack design. Outlines and contact areas are essentially fixed and must be interchangeable with other designs. It is, therefore, important that any novel modular jack substantially allow the use of conventional parts or tooling in its production.

A solution to the above-noted problems is proposed in U.S. Pat. No. 5,599,209, to Belopolsky, the inventor herein, entitled, "Method of Reducing Electrical Crosstalk and Common Mode Electromagnetic Interference and Modular Jack for Use Therein" ("Belopolsky '209"). This solution was proposed to reduce crosstalk and common mode electromagnetic interference in a modular jack by: (a) separating round wire conductors into two groups that are positioned in a distinct, separate area in the modular jack; (b) increasing the distance between adjacent conductors; (c) reducing the common length between adjacent conductors; and (d) using significantly different lengths for adjacent conductors. In the Belopolsky '209 connector, a first plurality of round wires extends in a common vertical plane from the bottom wall of the jack housing across the open rear end to the top wall and then extend horizontally forward and then angularly downwardly and rearwardly back toward the rear open end. A second plurality of wires extends first in a common vertical plane from the bottom wall across only a part of the rear open end and then extends obliquely, horizontally and upwardly toward the open front end. The downwardly extending oblique plane of the first plurality of wires and upwardly extending oblique plane of the second plurality of wires have a common length between 0.8 inch to 1.0 inch, while the length of the horizontal section of the first group of wires is relatively much longer being preferably 0.6 inch to 2.0 inch.

While the Belopolsky '209 modular jack is a vast improvement over the prior art modular jack connectors, there is still a need for a modular jack which further reduces crosstalk in telecommunications equipment. There is also a need for a modular jack which will further reduce common mode electromagnetic interference in telecommunications equipment. Particularly, there is a need for a modular jack connector that meets or exceeds Category 5 requirements. There is also a need for such an improved modular jack to be interchangeable with prior art modular jacks and to be manufactured using conventional parts and tooling. The present invention provides such a solution.

SUMMARY OF THE INVENTION

The present invention is directed to insulative inserts and conductive leads that may be used in fabricating modular jack connectors. The inserts include conductors having a rectangular cross section. In accordance with a first aspect of the invention, a first insert includes a first and second plurality of conductive leads that extend across a top wall in first and second common planes toward a front end. A first group of conductive leads form a terminal edge by extending toward the rear end of the first insert in a first common oblique plane. A second group of conductive extends angularly toward the front end from the second common plane in a second common oblique plane to form a second terminal edge which extends beyond the first terminal edge. A third group of leads may be provided that extend across portions of the top wall in both the first and second common planes. The first and second oblique planes intersect to form a first contact area.

In accordance with another aspect of the invention, a second insert includes a third and fourth plurality of conductive leads that extend across a top wall in third and fourth common planes. A third group of leads forms a terminal edge by extending toward the rear end of the second insert in a third common oblique plane. A fourth group of leads extends angularly from the fourth common plane toward the front end in a fourth common oblique plane to form a fourth terminal edge which extends beyond the third terminal edge. The third and fourth oblique planes intersect to form a second contact area.

In accordance with yet another feature of the present invention, a modular jack connector assembly may be assembled from the first and second inserts.

Other features and aspects will be described herein.

BRIEF DESCRIPTION OF THE DRAWINGS

The foregoing summary, as well as the following detailed description of the preferred embodiments, is better understood when read in conjunction with the appended drawings. For the purpose of illustrating the invention, there is shown in the drawings an embodiment that is presently preferred, in which like references numerals represent similar parts throughout the several views of the drawings, it being understood, however, that the invention is not limited to the specific methods and instrumentalities disclosed. In the drawings.

DETAILED DESCRIPTION OF THE PREFERRED EMBODIMENTS

Figure 1:
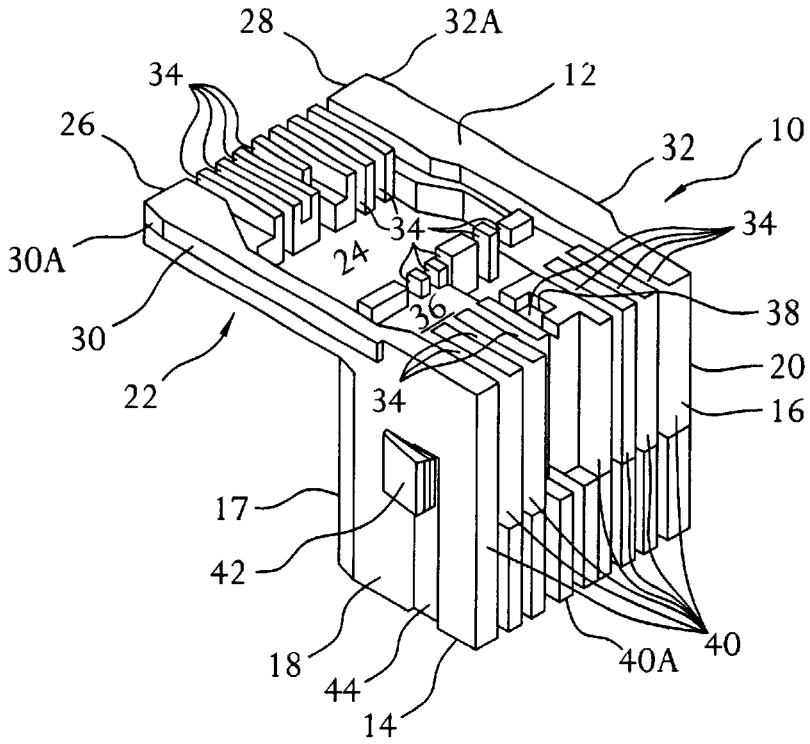
FIG. 1 is a perspective view of a first insert adapted for use in a modular jack assembly.
Figure 2:
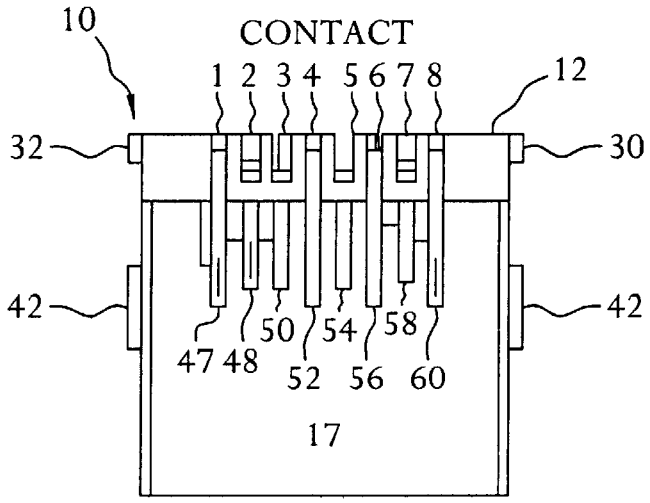
FIGS. 2–5 are front, side, rear and top views of the insert of FIG. 1 with a first arrangement of conductive leads, respectively.

"The present invention is directed to novel connector inserts for use in a modular jack assembly to provide electrical connections between devices. Referring now to FIG. 1, there is illustrated a first insert 10 that may be used to fabricate a modular jack connector in accordance with an embodiment of the present invention. The insert 10 includes a top wall 12, a bottom wall 14, a rear wall 16, a front wall 17, and a pair of opposed lateral walls 18 and 20. A cantilevered portion 22 is formed extending forward of the front wall 17. The cantilevered portion 22 has an opening 24 there through. It is noted that the overall dimensions of the first insert 10 are sized such that it may be used in an industry standard modular jack connector. The material from which the insert 10 is constructed is preferably a thermoplastic polymer having suitable insulative properties."

Figure 14:
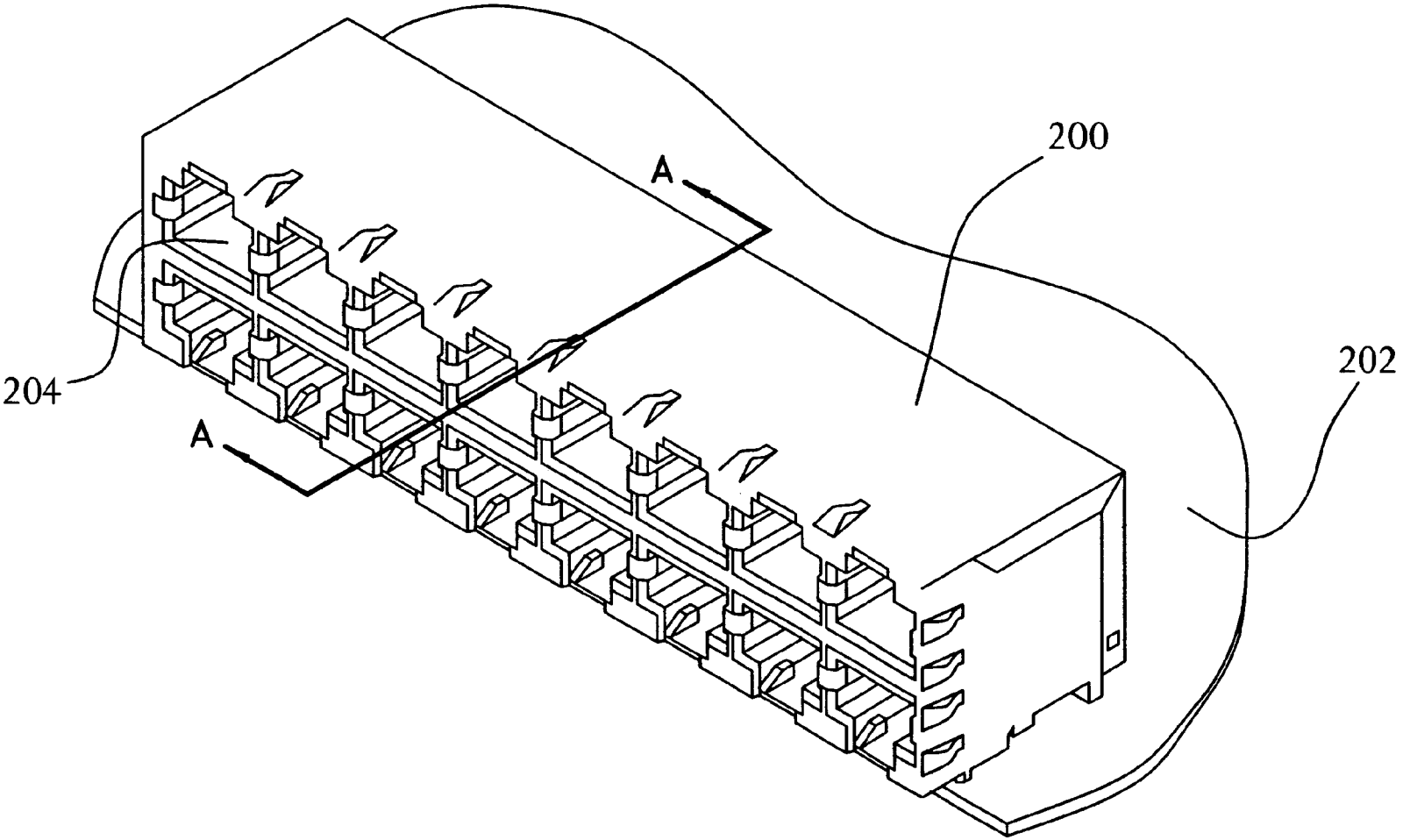
FIG. 14 is a perspective view of a modular jack assembly in which the first and second inserts of the present invention may be utilized.

The top wall 12 includes a pair of outer members 26 and 28 that extend the length of the top wall 12. The outer members 26 and 28 each define a projecting member 30 and 32 that extends outwardly from the lateral walls 18 and 20, respectively, to enable the insert 10 to be positioned and secured within a connector assembly housing (FIG. 14). The projecting members and 32 each have an angled forward portion 30A and 32A and extend rearward on the lateral walls 18 and to a point behind a vertical plane formed by the front wall 17.

A plurality of upper grooves 34 are formed within the top wall 12 that extend from the front of the first insert 10 to the opening 24. The upper grooves 34 are provided such that electrical conductors may be disposed within the first insert 10. The upper grooves 34 preferably have varying depths within the top wall 12 depending on the particular groove's position in the top wall 12. Varying the depth of the upper grooves advantageously reduces cross talk between conductors disposed within the grooves by placing predetermined conductors in different horizontal planes (see, detailed discussion below).

Figure 4:
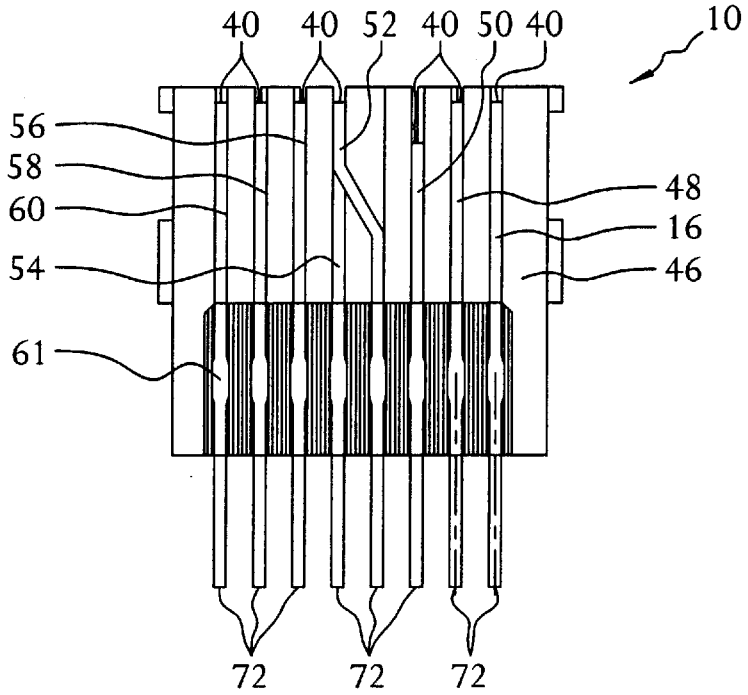
Figure 8:
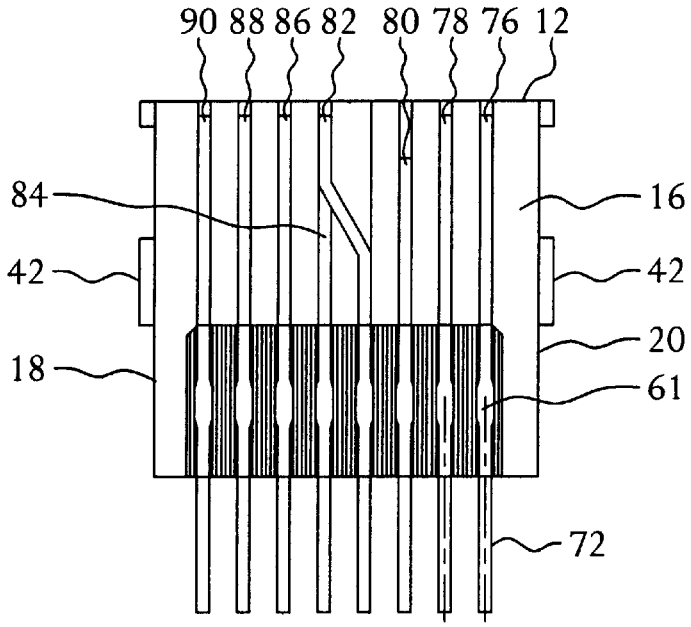
FIGS. 6–8 are side, rear and top views of the insert of FIG. 1 with a second arrangement of conductive leads, respectively.

The upper grooves 34 extend rearward from the opening 24 in two general sections separated by a space 36. A tab 38 is formed in one of the upper grooves 34. At the rear of the top wall 12, the upper grooves 34 meet corresponding rear grooves 40 formed in the rear wall 16. For reasons which will be discussed below, only selected ones of the upper grooves 34 have corresponding rear grooves 40. At approximately 40% of the height of the rear wall 16, additional rear grooves 40A are provided such that each conductor placed therein may be secured within its respective rear groove using a flared portion 61 of the conductor (see, FIG. 4).

Each of the laterally opposed side walls 18 and have a tab 42 formed thereon that extends outwardly from the side walls. The tab 42 is provided to enable the first insert 10 to be mounted within an assembly. An outermost edge of the tabs 42 is formed in a generally rectangular recess 44 within each of the side walls 18 and 20.

FIGS. 2–5 and 5A–5H illustrate the first insert 10 of the present invention having electrical conductors 46–60 disposed within the upper and rear grooves 34 and 40. It is noted that FIGS. 5A–5H illustrate several sections of the first insert 10 of FIG. 1 to provide additional details to one of ordinary skill in the art. As illustrated there are preferably eight conductors disposed within the grooves of the first insert 10. Unlike prior art solutions utilizing round wire conductors, the present invention advantageously utilizes conductors having a rectangular cross section that are preferably stamped from a single piece of flat metal stock (e.g., a lead frame). In accordance with the present invention, the conductors preferably have a thickness of 8–16 mils (1/1000 of an inch) and a width of 12–24 mils.

The conductors 46–60 are preferably arranged into three groups within the upper grooves 34. Each group is positioned in substantially different horizontal planes (see, planes A and B in FIGS. 5A–5H). The first group of conductors (64, 52, 56 and 60) are disposed in plane A and form connector contacts 1, 4, 6 and 8 ("Group A"). The second group of conductors (50 and 54) are disposed in plane B and form connector contacts 3 and 5 ("Group B"). Plane B is preferably approximately 1.3 mm below that of the plane A. A portion of the third group of conductors (48 and 58) is disposed in each of planes A and B and form connector contacts 2 and 7 ("Group C"). Placing the groups of conductors in different horizontal planes further reduces crosstalk and common mode interference versus conventional arrangements that have conductors disposed within a same plane.

As illustrated in FIG. 3 and FIGS. 5A–5H, the three groups of conductors each have different shapes. The Group A conductors 64, 52, 56 and 60 that form contacts 1, 4, 6 and 8 are illustrated in FIGS. 5A, 5D, 5F and 5H, respectively. These conductors are formed generally as an "L"-shaped section 62 having an angled portion 64. The angled portion 64 is formed at an angle of approximately 23–29° with respect to the horizontal portion of the "L"-shaped section and extends to approximately 3–4 mm below the bottom of the canterlevered portion 22 of the insert 10. The conductors 46–60 (contacts) preferably do not have a uniform pitch at the front compared to the rear of the insert 10. For example, conductors 46–60 could have a pitch of 0.040 inches at the front of the insert 10 and 0.050 inches at the rear of the insert 10.

Figure 5:
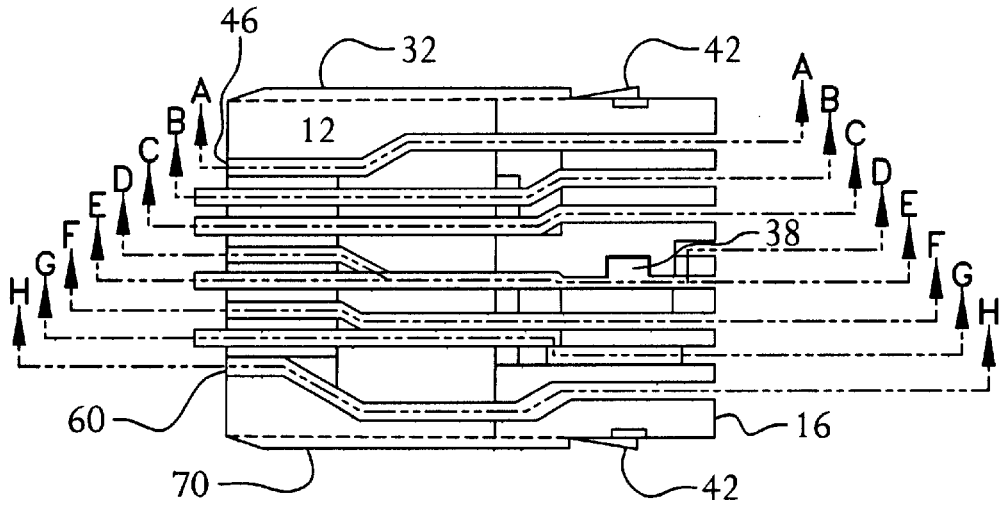
Figures 5A, 5B, 5C, 5D, 5E, 5F, 5G, 5H:
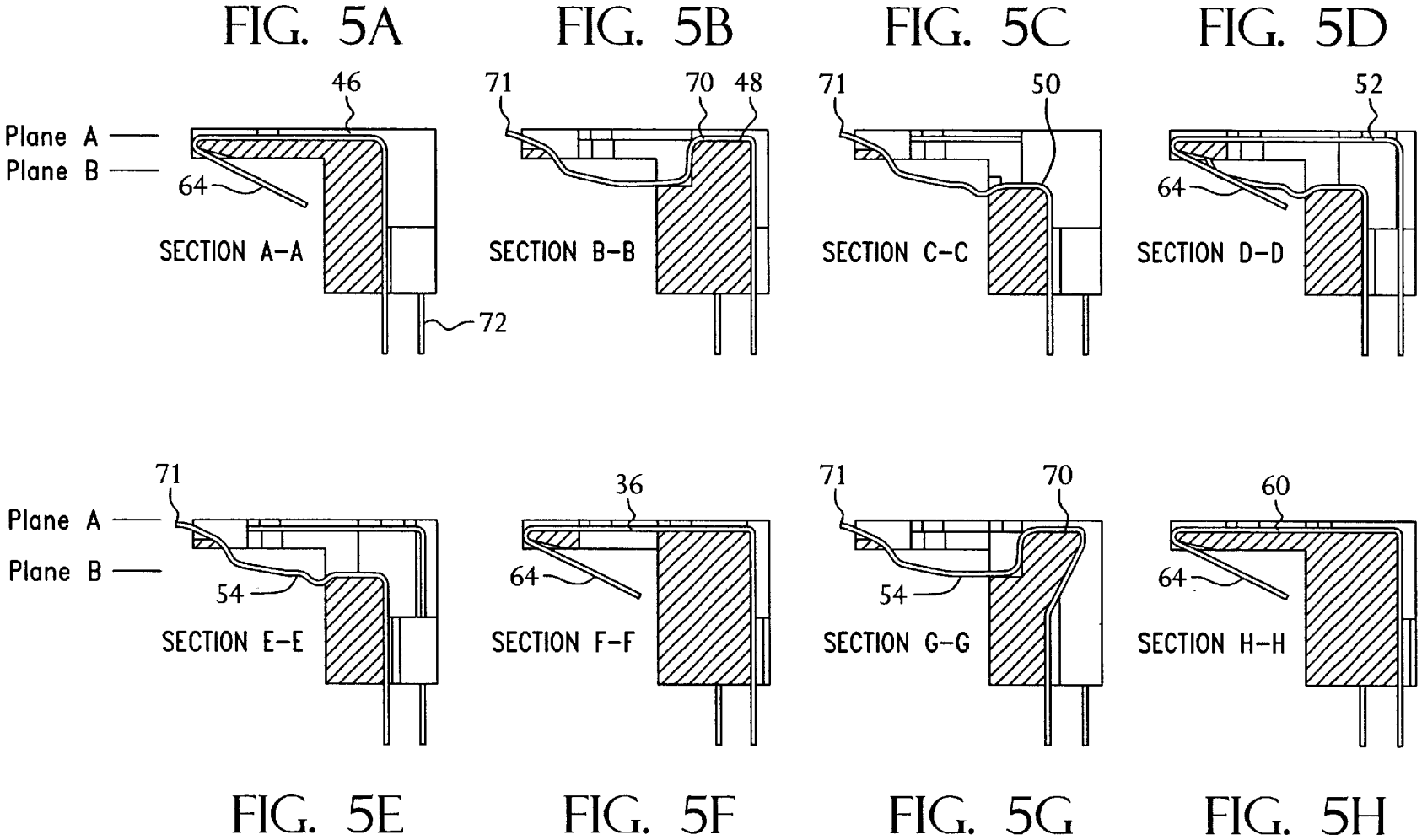
FIGS. 5A–5H are sectional views taken through lines A—A, B—B, C—C, D—D, E—E, F—F, G—G, and H—H of FIG. 5.

The Group B conductors that form contacts 3 and are illustrated in FIGS. 5C and 5E. The conductors 50 and 54 have a small semi-circular portion adjacent to the front wall 17 and extend upwardly at an angle of approximately 11°. The terminal end 71 of the conductors 50 and 54 protrudes from the front of the insert at an angle of approximately 23°.

The Group C conductors 48 and 58 that form contacts 2 and 7 are illustrated in FIGS. 5B and 5G, respectively. The conductors each include a "stitched" portion 70 in plane A, extend outwardly from the front wall 17, and then upwardly from the front wall 17 at an angle of approximately 11° with respect to the horizontal. A terminal end 71 of the conductors 48 and 58 protrudes from the front of the first insert 10 approximately 1–2 mm at an angle of approximately 23°.

Figure 3:
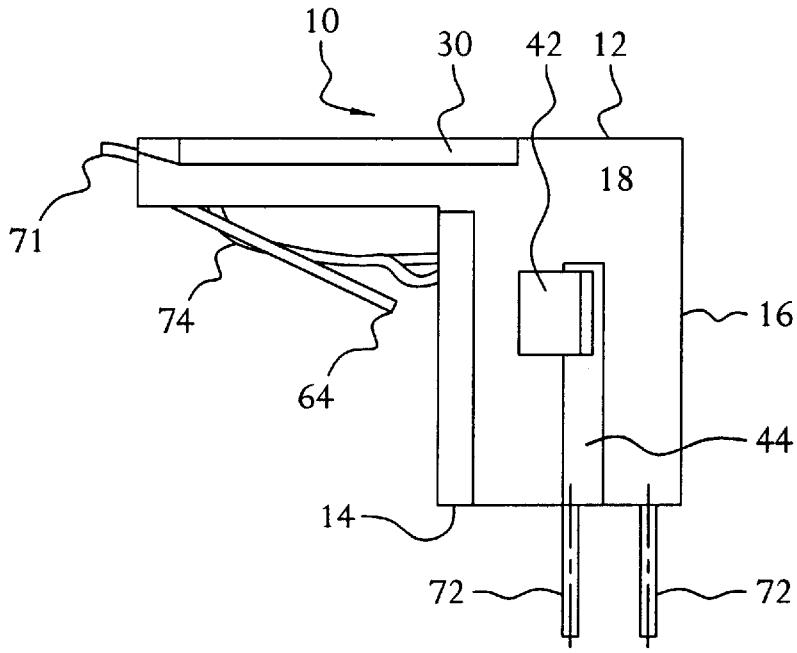

As illustrated in FIG. 3, each of the conductors 46–60 forms aligned contact areas 74 that lie substantially within an oblique plane. It is intended that when a modular jack is mated to the conductors 46–60 of the first insert 10, the contacts of the modular jack electrically contact their respective conductors 46–60 in the contact area 74. It is also preferable to selectively plate the contact area 74 using a multilayered arrangement of conductive metals, such as nickel, gold and palladium. For example, the contact area 74 may be plated using known means having a 50 microinch layer of nickel covered by a 5–100 microinch layer of gold or palladium.

To further reduce crosstalk, it is preferable to reduce the distance that the conductors 46–60 run in parallel along the top wall 12 and to have a portion the conductor occupying the fourth position extend in parallel and on top of the conductor occupying the fifth position. As best illustrated in FIGS. 4, 5, 5D and 5E, a portion of the conductor 52 in the fourth position runs in a parallel horizontal plane above the conductor 54 in the fifth position on the top of the first insert 10, and in a parallel vertical plane behind the conductor 54 in the fifth position at the rear of the first insert 10. Also, as can be understood from FIGS. 5D and 5E, the fourth conductor 52 will conduct current received from a modular jack in contact therewith upward through angled portion 64, while the fifth conductor 54 will conduct current from the modular jack downward with respect to the first insert 10. Similarly, as can be understood from FIGS. 3 and 5A–5H, Group A conductors that are disposed adjacent to conductors of Groups B and C will each conduct current received from a modular jack in contact therewith in opposite directions. Crosstalk and interference may be further reduced by conducting current in reverse directions through the frontal portions of the conductors.

In addition to placing the groups of conductors in different planes and reducing the distance they run in parallel along the top of the insert 10, the groups of conductors preferably have different horizontal lengths as measured along the top of the first insert 10. In the present exemplary arrangement, the group B and C conductors have a horizontal length between 20 and 60% of the horizontal length of the group A conductors. In addition, it is preferable to have the horizontal portion of the Group B conductors in a plane below that of the corresponding portion of the Group C conductors. Further, it is preferable to have the tail portions 72 of the conductors exit the first insert 10 in different planes. As illustrated in FIG. 3, the exiting tails 72 are separated into two planes that are approximately 2.5 mm apart and each tail is separated from an adjacent tail 72 by approximately 1.27 mm.

Table 1 illustrates test results of crosstalk between contacts in connectors using the first insert 10 of the present invention having the arrangement of conductors as noted above in FIGS. 3–5 and 5A–5H, with respect to the Category 5 Requirement.

TABLE 1

| | Near End Crosstalk, dB @ 100 MHz | | | | | |
|---|---|---|---|---|---|---|
| Item | ½–⅜ | ½–⅘ | ½–⅞ | ⅜–⅘ | ⅘–⅞ | ⅜–⅞ |
| Sample 1 | 46.3 | 46.2 | 63.3 | 46.9 | 43.6 | 50.1 |
| Sample 2 | 45 | 52.1 | 53.3 | 41.2 | 45.9 | 45.3 |
| Sample 3 | 50 | 43.5 | 52 | 42.2 | 46 | 45.8 |
| Cat. 5 Req't | 40.0 | 40.0 | 40.0 | 40.0 | 40.0 | 40.0 |

FIGS. 6–8 and 8A–8B illustrate the first insert 10 of the present invention having a second arrangement of electrical conductors 76–90 disposed therein. As illustrated there are preferably eight conductors disposed within the first insert 10 in accordance with the second arrangement. The conductors 76–90 are preferably arranged into two groups (Groups D and E). Group D includes conductors 76, 82, 86 and 90 disposed in plane D that form connector contacts 1, 4, 6 and 8. Group E includes conductors 78, 80, 84 and 88 disposed in plane E that form connector contacts 2, 3, 5 and 7. Plane E is preferably 1.3 mm below that of the plane D. As in the example above according to the first arrangement of conductors, the conductors 76–90 have a rectangular cross section. The conductors 76–90 (contacts) preferably do not have a uniform pitch at the front compared to the rear of the insert 10. For example, conductors 76–90 could have a pitch of 0.040 inches at the front of the insert 10 and 0.050 inches at the rear of the insert 10.

Figure 6:
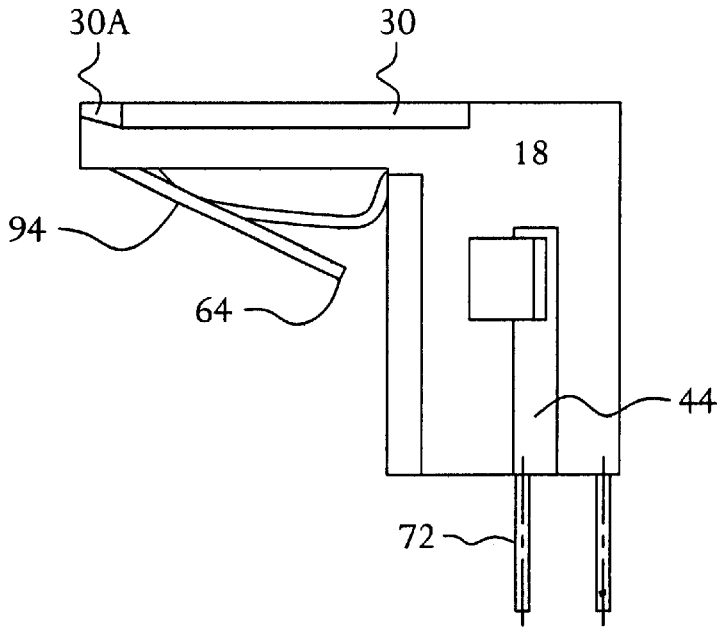
Figure 7:
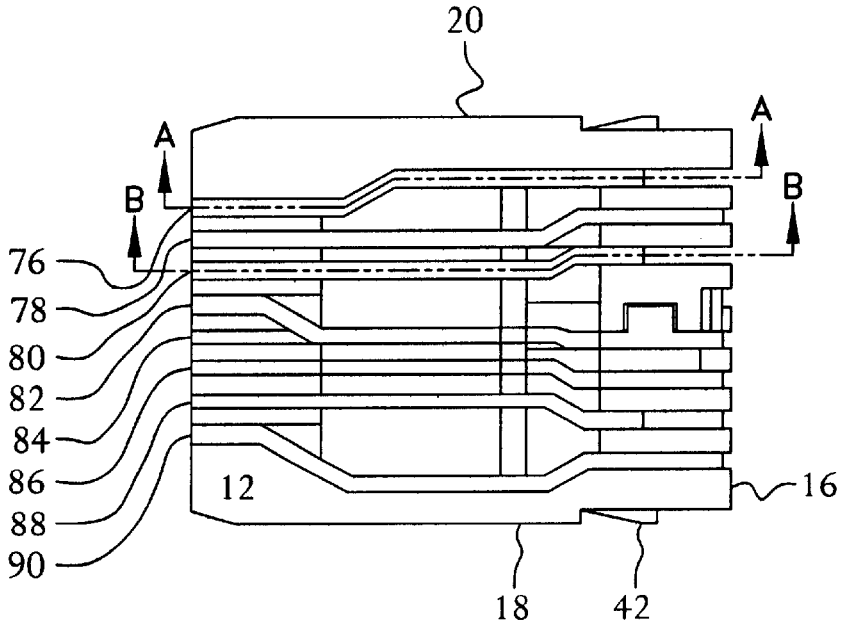
Figure 8A:
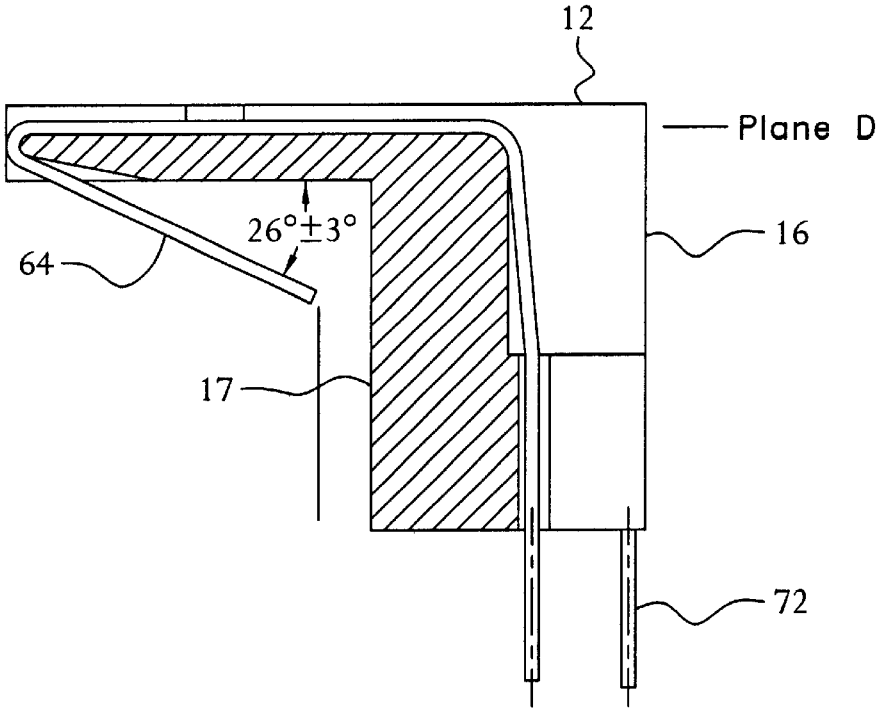
FIGS. 8A–8B are sectional views taken through lines A—A and B—B of FIG. 8.
Figure 8B:
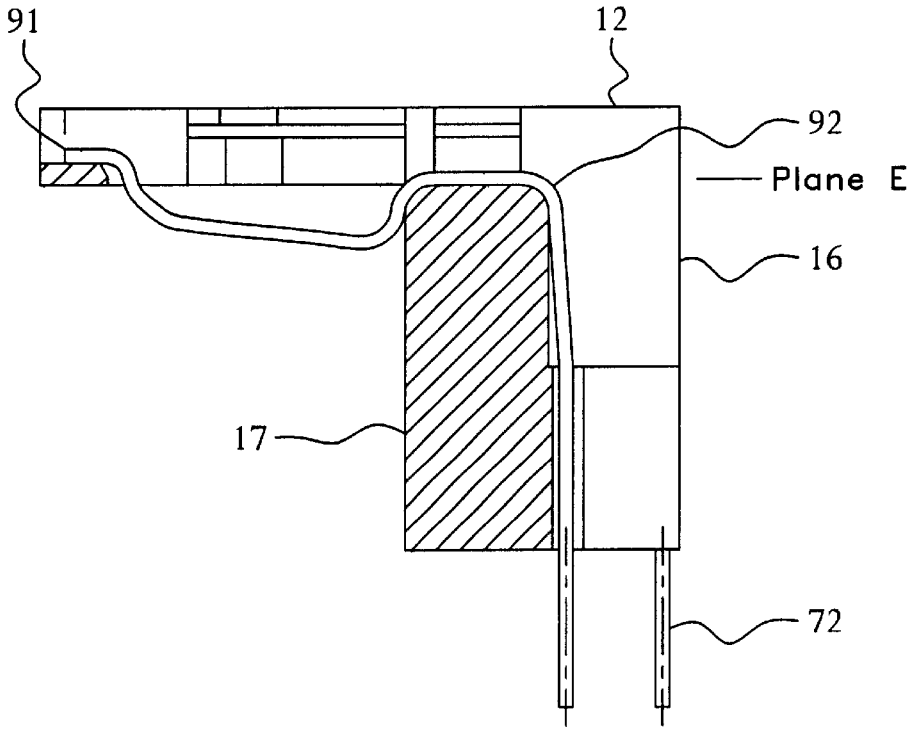

As illustrated in FIGS. 6 and 8A–8B, the two groups of conductors have differing shapes to reduce crosstalk and common mode interference. The Group D conductors 76, 82, 86 and 90 that form connector contacts 1, 4, 6 and 8 are illustrated in FIG. 8A. These conductors have a substantially similar structure to those of Group A described with reference to FIGS. 5A, 5D, 5F and 5H, and will not be described in detail.

The Group E conductors 78, 80, 84 and 88 that form connector contacts 2, 3, 5 and 7 are illustrated in FIG. 8B. The conductors 78, 80, 84 and 88 each include a "stitched" portion 92 and extend upwardly from the front wall 17 at an angle of approximately 11° with respect to the horizontal. The terminal end 91 of the conductors 78, 80, 84 and 88 terminates approximately 0.34 mm from the front of the first insert 10.

As illustrated in FIG. 6, each of the conductors 76–90 forms aligned contact areas 94 that lie substantially within an oblique plane. It is intended that when the modular jack is inserted into an assembly containing the insert 10 according to the second arrangement of conductors, the contacts of the modular jack electrically contact their respective conductors 76–90 in the contact area 94. Also as in the example above, the contact area 94 preferably has a multilayered plated region.

As noted above, to further reduce cross talk, it is preferable to reduce the distance that the conductors 76–90 run in parallel along the top wall 12, and have a portion of the conductor occupying the fourth position (groove 34D) extend in parallel and on top of the conductor occupying the fifth position (groove 35D) of the first insert 10. As best illustrated in FIGS. 7, 8, 8A and 8B, a portion of the conductor 82 in the fourth position runs in a parallel horizontal plane above the conductor 84 in the fifth position on the top of the first insert 10, and in a parallel vertical plane behind the conductor 84 in the fifth position at the rear of the first insert 10. Also, as can be understood from FIGS. 8A and 8B, the fourth conductor will conduct current received from a modular jack in contact therewith upward through angled portion 64, while the fifth conductor will conduct current from the modular jack downward with respect to the first insert 10. Similarly, it is noted that conductors of Group D that are adjacent to conductors of Group E will each conduct current received from a modular jack in contact therewith in opposite directions.

In addition to placing the groups of conductors in different planes and reducing the distance they run in parallel along the top of the insert 10, the groups of conductors preferably have different horizontal lengths as measured along the top of the first insert 10. For example, the group E conductors have a horizontal length between 20 and 60% of the horizontal length of the group D conductors. Further, it is preferable to have the tail portions 72 of the conductors exit the first insert 10 in different planes. As illustrated in FIG. 6, the exiting tails 72 are separated into two planes that are approximately 2.5 mm apart and each tail is separated from an adjacent tail 72 by approximately 1.27 mm.

Figure 9:
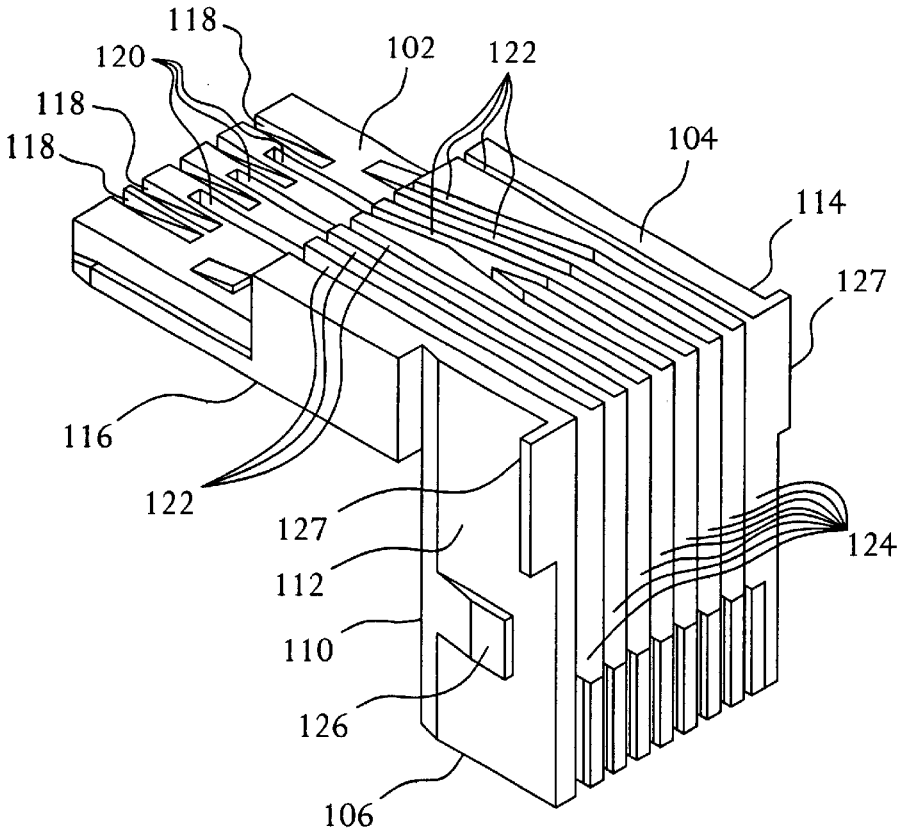
FIG. 9 is a perspective view of a second insert adapted for use in a modular jack assembly.

"FIG. 9 illustrates a second insert 100 that may be used to fabricate a connector in accordance with the present invention. The second insert 100 includes a first top wall 102, a second top wall 104, a bottom wall 106, a rear wall 108, a front wall 110, and a pair of opposed lateral walls 112 and 114. A cantilevered portion 116 is formed extending forward of the front wall 110 and includes the first top wall 102 and a portion of the second top wall 104. The material from which the second insert 100 is constructed is preferably a thermoplastic polymer having suitable insulative properties."

Figure 12:
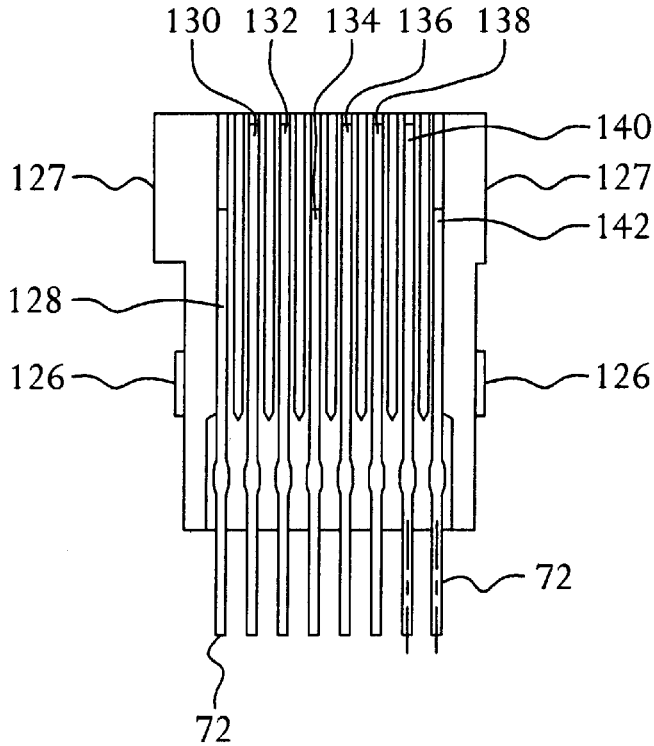

The first top wall 102 defines a plurality of angled grooves 118 (having an angle of approximately 15°) and first upper grooves 120. The second top wall 104 is approximately 2.2 mm above the first top wall 102 and defines second upper grooves 122. The first and second upper grooves are provided such that electrical conductors may be disposed within the second insert 100 (to be described in greater detail below). The second upper grooves 122 continue rearward from the front edge of the second top wall 104 and meet corresponding rear grooves 124 formed in the rear wall 108. At approximately 28% of the height of the rear wall 108, the rear grooves 124 are shaped such that each conductor may be secured using a flared portion 61 within its corresponding groove in the rear wall 108 (see, e.g., FIG. 12).

Each of the laterally opposed lateral walls 112 and 114 have formed thereon a first tab 126 and second tab 127 that extend outwardly from the opposed lateral walls 112 and 114. The tab 126 may be used in mounting the second insert 100 within a modular jack assembly.

FIGS. 10–13 and 13A–13H illustrate the second insert 100 of the present invention having electrical conductors 128–142 disposed therein. It is noted that FIGS. 13A–13H illustrate several sections of the second insert 100 of FIG. 9 to provide additional details to one of ordinary skill in the art. As illustrated there are preferably eight conductors disposed within the second insert 100. The conductors each have a rectangular cross section and are preferably stamped from a single piece of flat metal stock (e.g., a lead frame). The conductors preferably have a thickness of 8–16 mils (1/1000 of an inch) and a width of 12–24 mils. The conductors 128–142 (contacts) preferably do not have the same pitch at the front compared to the rear of the insert 100. For example the conductors may have a pitch of 0.040 inches at the front of the insert 100 and 0.050 inches at the rear of the insert 100.

Figure 10:
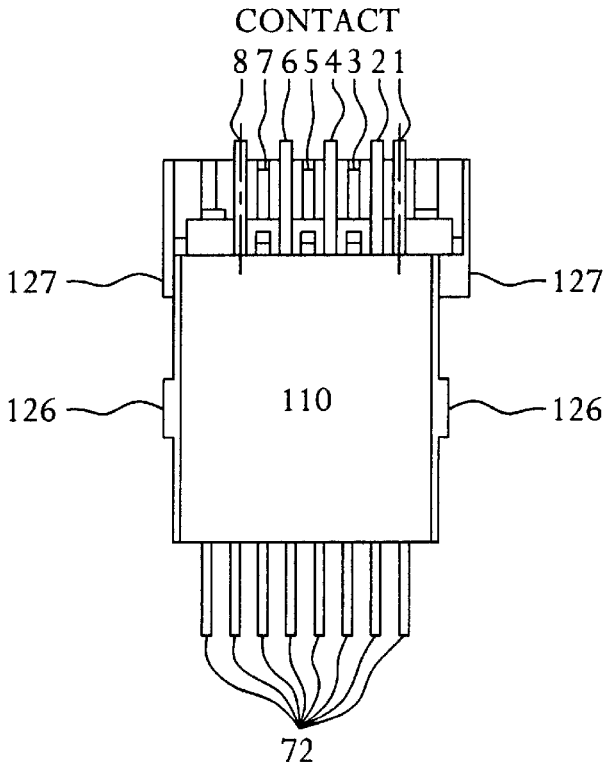
FIGS. 10–13 are front, side, rear and top views of the insert of FIG. 9 with an arrangement of conductive leads, respectively.
Figure 11:
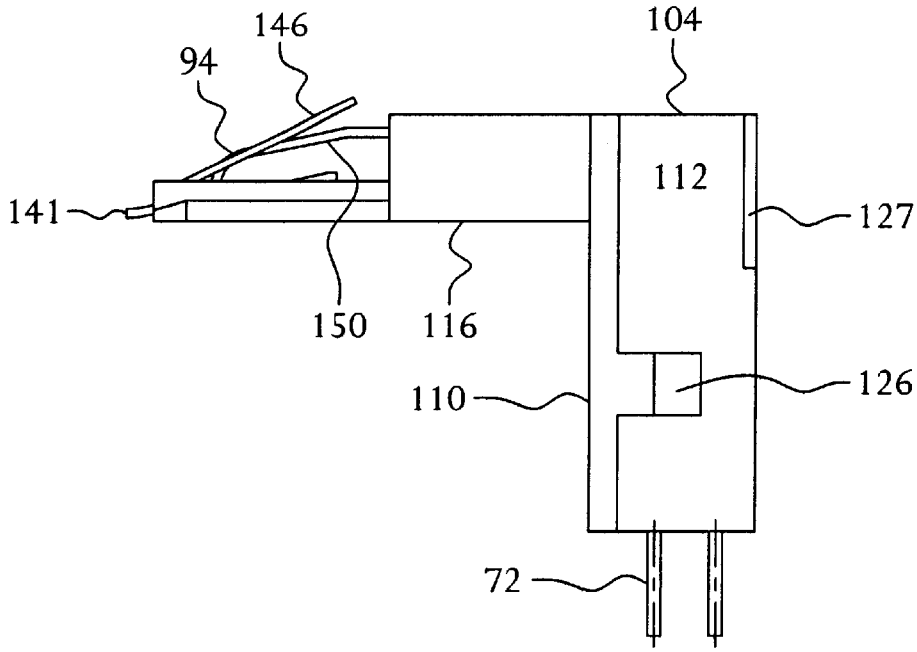

As best shown by FIGS. 10 and 11, the conductors 128–142 are preferably arranged into two groups, with selected members of the first group being positioned in different horizontal planes (illustrated as planes F and G). The first group (Group F) includes conductors 128, 134 and 142 that form contacts 1, 4 and 8 that are disposed in plane F, whereas conductors 130 and 138 that form contacts 2 and 6 are located in plane G. Plane G is approximately 3.5 mm below that of plane F. The second group (Group G) of conductors 132, 136 and 140 that form contacts 3, 5 and 7 are located in plane G.

As illustrated in FIG. 11 and FIGS. 13A–13H, the two groups of conductors preferably have differing shapes to reduce crosstalk and common mode interference. The conductors 128, 130, 134, 138 and 142 that form contacts 1, 2, 4, 6 and 8 are illustrated in FIGS. 13A, 13B, 13D, 13F and 13H, respectively. These conductors 128,130,134,138 and 142 are formed having a generally "L"-shaped section 144 and an angled portion 146. The angled portion 146 is formed at an angle of approximately 23–29° with respect to the horizontal portion of the "L"-shaped section. The conductors 132, 136 and 140 that form contacts 3, 5 and 7 are illustrated in FIGS. 14C, 14E and 14G, respectively. These conductors also have an "L"-shaped section 148 and a forward downward portion 150 (angled at approximately 11°). An "S"-shaped bend follows the downward portion 150 and the terminal ends of the conductors 132, 136 and 140 extend outward of the front of the second insert 100 at approximately an 11° angle to form a terminal end 141.

As illustrated in FIG. 11, each of the conductors 128–142 form aligned contact areas 152 that lie substantially within an oblique plane. It is intended that when the modular jack is inserted into a modular jack connector assembly utilizing the second insert 100, the contacts of the modularjack electrically contact their respective conductors 128–142 in the contact area 152. It is also preferable to use selective plating of the contact area 152 of the conductors 128–142 using a multilayered arrangement of conductive metals, such as nickel, gold and palladium. For example, the contact area may be plated using known means having a 50 microinch layer of nickel covered by a 5–100 microinch layer of gold or palladium.

Figure 13:
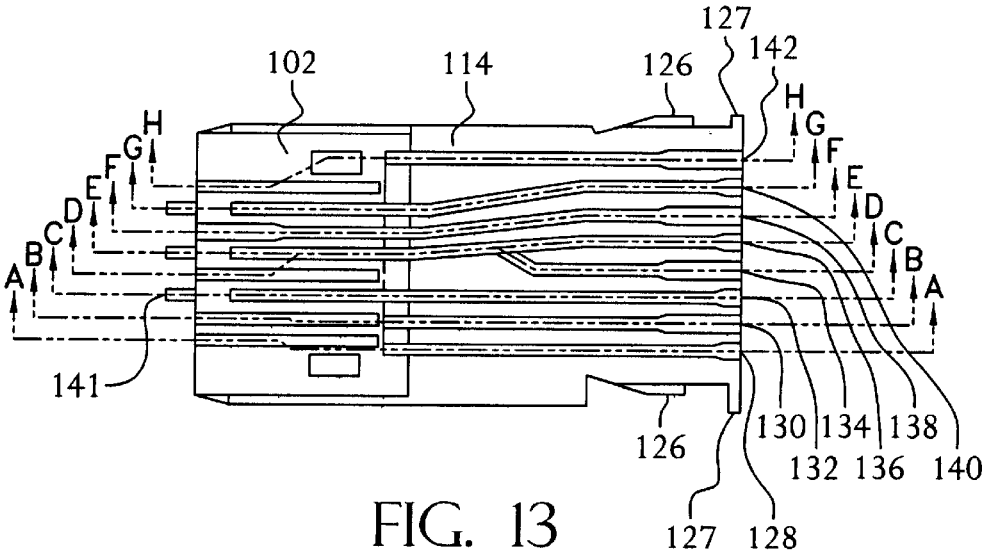
Figure 13A:
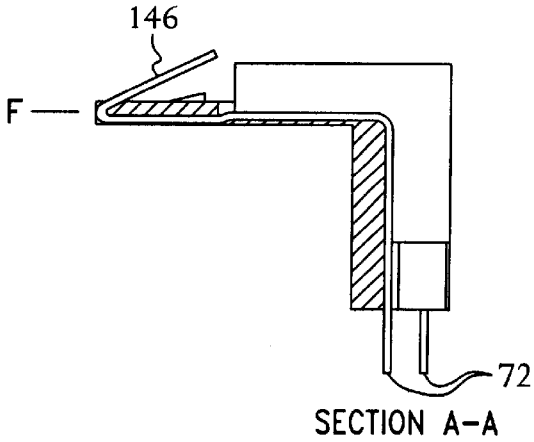
FIGS. 13A–13H are sectional views taken through lines A—A, B—B, C—C, D—D, E—E, F—F, G—G, and H—H of FIG. 13.
Figure 13B:
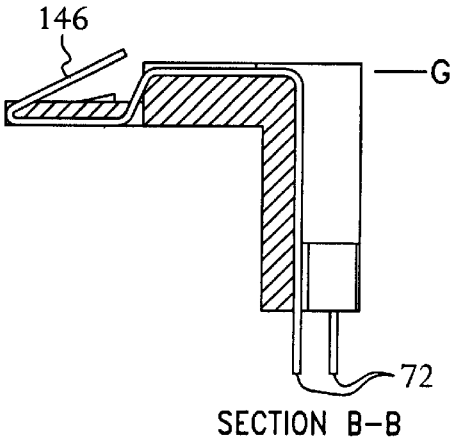
Figure 13C:
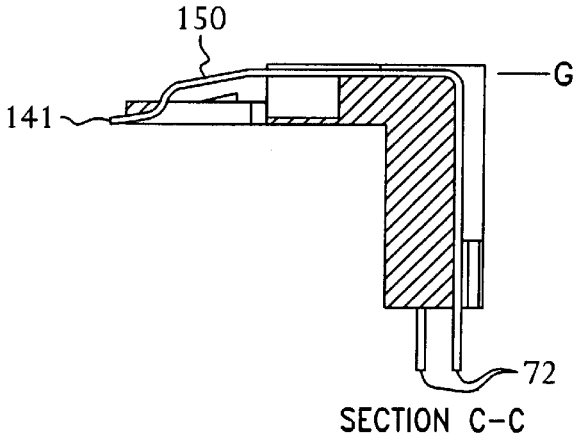
Figure 13D:
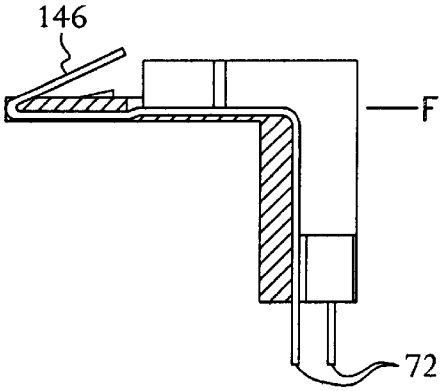
Figure 13E:
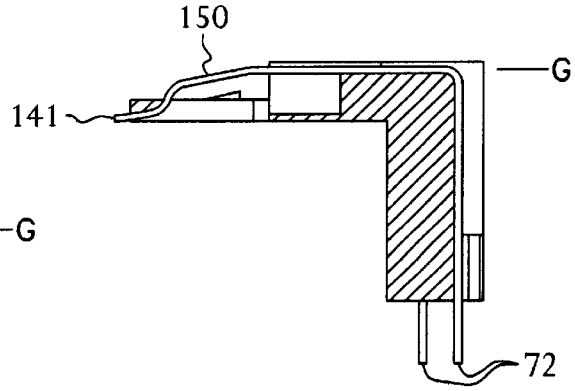
Figure 13F:
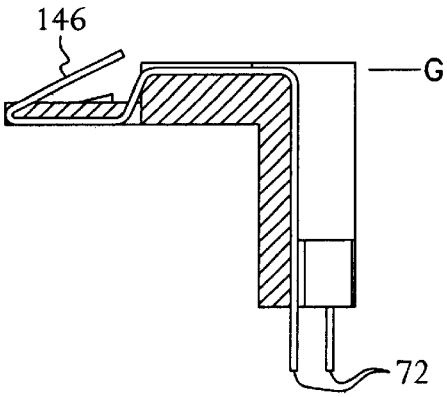
Figure 13G:
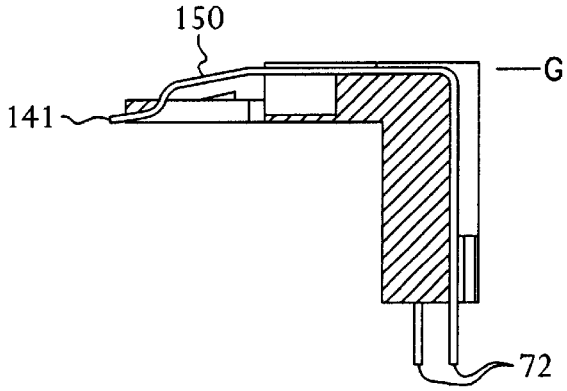
Figure 13H:
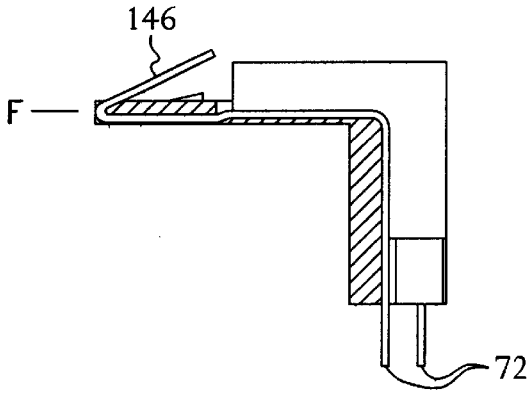

To further reduce crosstalk, it is preferable to reduce the distance that the conductors 128–142 run in parallel along the second top wall 104 and to have the fourth conductor 134 overlap the fifth conductor 136. As best illustrated in FIG. 13, a portion of the conductor 134 in the fourth position runs in a parallel horizontal plane above the conductor 136 in the fifth position for a portion of the second top wall 104. Also, as can be understood from FIGS. 11 and 13A—13A, the fourth conductor will conduct current received from a modular jack in contact therewith downward through angled portion 146, while the fifth conductor will conduct current from the modularjack generally upward. Similarly, adjacent conductors from Groups F and G will each conduct current received from a modular jack in contact therewith in opposite directions to further reduce crosstalk. Further, it is preferable to have the tail portions 72 of every other conductor exit the second insert 100 in different planes. As illustrated in FIG. 11, the exiting tails 72 are separated into two planes that are approximately 2.5 mm apart and each tail is separated from an adjacent tail 72 by approximately 1.27 mm.

Figure 15:
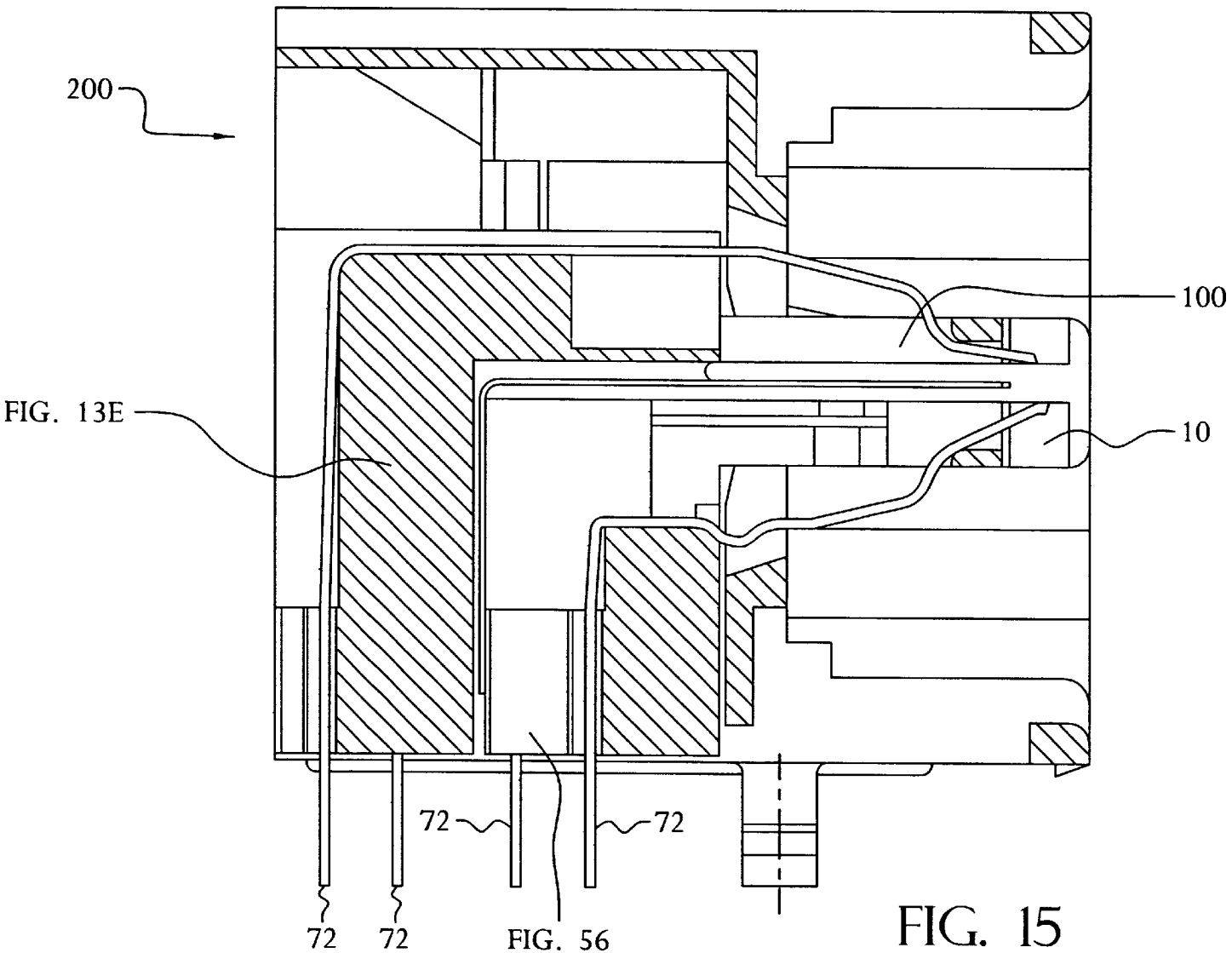
FIG. 15 is a sectional view of the modular jack assembly of FIG. 14 taken through lines A—A of FIG. 14.

Referring now to FIG. 14, there is illustrated a modular jack connector assembly 200 which utilizes the inserts of the present invention. In accordance with a feature of the present invention, the first and second inserts 10 and 100 may be stacked together and mounted within the modular jack connector assembly 200 to form a double deck assembly. FIG. 14, illustrates such an exemplary 8 port double deck modular jack assembly utilizing the first and second inserts 10 and 100. Such an assembly may be mounted to, e.g., a printed circuit board 202 to provide connections between various communications-related equipment. The assembly 200 includes a plurality of modular jack connectors 204 that are adapted to receive modular jacks such as an industry standard RJ45 modular jack having 8 conductors. FIG. 15 illustrates a cross-sectional diagram taken along line A—A of FIG. 14. It is noted that the arrangement of the conductors within the first and second inserts 10 and 100 advantageously reduces crosstalk and common mode interference such that shielding (i.e., a middle ground) is not required between the inserts 10 and 100 to reduce crosstalk to acceptable levels, as evidenced by Table 2 below.

TABLE 2

| Pair combination | No middle shield (dB) | With middle shield (dB) |
|---|---|---|
| ½–½ | 67 | 72 |
| ½–⅘ | 60 | 61 |
| ½–⅜ | 65 | 68 |
| ⅞–½ | 56 | 55 |
| ⅘–⅘ | 62 | 66 |
| ⅜–⅜ | 45.3 | 48.4 |
| ⅘–⅜ | 66 | 64 |

It will be appreciated that there has been described a method of reducing or eliminating crosstalk as well as common mode electromagnetic interference and a modular jack for use therein. It will also be appreciated that this modular jack is interchangeable with conventional modular jacks and can be manufactured easily and inexpensively with conventional pads and tooling. Further, the present invention provides for an overall design that allows the incorporation of a shallower latch.

The present invention may be employed in other specific forms without departing from the spirit or essential attributes thereof For example, any number of materials may be used in manufacturing the disclosed latch member. While the invention has been described and illustrated with reference to specific embodiments, those skilled in the art will recognize that modification and variations may be made without departing from the principles of the invention as described herein above and set forth in the following claims. For example, a number other than eight conductive leads may be provided as necessary within the inserts.

What is claimed:

1. An insulative insert having contacts for signal transmission, comprising:

a front end, a rear end, a bottom wall, and a top wall, said top wall defining grooves therein;

a first plurality of conductive leads extending from said bottom wall of the insulative insert and across said top wall in a first common plane toward said front end of said insert, thereafter said first plurality of conductive leads forming a first terminal edge by extending toward said rear end of said insulative insert in a first common oblique plane;

a second plurality of conductive leads extending from said bottom wall of the insulative insert and across a portion of said top wall in a second common plane, and thereafter angularly toward the front end of said insulative insert in a second common oblique plane forming a second terminal edge which extends forward of said first terminal edge; and a third plurality of conductive leads extending from said bottom wall of the insulative insert and across a first portion of said top wall in said first common plane and then along a second portion of said top wall in said second common plane, said third plurality of conductive leads then extending angularly toward the front end in said second common oblique plane to said second terminal edge;

wherein said first oblique plane and said second oblique plane intersect at a contact area.

2. The insulative insert of claim 1, wherein said first plurality of conductive leads and second plurality of conductive leads have different horizontal lengths as measured along said top wall of said insulative insert.

3. The insulative insert of claim 2, wherein said second conductive leads have an overall length between approximately 20 and 60% of said first conductive leads.

4. The insulative insert of claim 1, wherein predetermined ones of said first plurality of conductive leads and second plurality of conductive leads extend from said bottom wall to said top wall in two generally parallel planes.

5. The insulative insert of claim 1, wherein said second common plane is approximately 1.3 mm offset from said first common plane.

6. The insulative insert of claim 1, wherein each of said first and second plurality of conductive leads have a thickness between approximately 8 and 16 thousandths of an inch and a width between approximately 12 and 24 thousandths of an inch.

7. The insulative insert of claim 1, wherein said plurality of grooves comprises eight grooves, conductive leads are disposed in a fourth groove and a fifth groove of said eight grooves, and said conductive lead disposed within said fourth groove extends parallel and on top of a predetermined portion of said conductive lead disposed within said fifth groove.

8. The insulative insert of claim 7, wherein said fourth groove defines a tab to receive said conductive lead disposed within said fourth groove.

9. The insulative insert of claim 1, wherein said first common oblique plane is between approximately 23–29° with respect to said top wall, and said terminal edge extends approximately 3 to 4 mm below an underside of said top wall.

10. The insulative insert of claim 9, wherein said second common oblique plane is angled at approximately 7–13° with respect to said top wall.

11. The insulative insert of claim 1, wherein said first, second and third pluralities of conductive leads form said contact area.

12. The insulative insert of claim 1, wherein said third plurality of conductive leads have a rectangular cross section.

13. The insulative insert of claim 1, wherein each of said conductive leads comprises a flared portion to secure said conductive leads within said insulative insert.

14. The insulative insert of claim 1, said insulative insert adapted to be mounted within a modular jack connector assembly, and said modular jack connector assembly receiving said another connecting element.

15. The insulative insert of claim 1, wherein each of said first and second conductive leads each have a rectangular cross section.

16. The insulative insert of claim 1, wherein said conductive leads have a first pitch at a front of said insert and a second pitch at a rear of said insert, and wherein said second pitch is different than said first pitch.

17. The insulative insert of claim 16, wherein said first pitch is approximately 0.040 inches and said second pitch is approximately 0.050 inches.

18. The insulative insert of claim 1, wherein said conductive leads are plated only in said contact area.

19. A modular jack connector comprising:

a first insert, comprising:

a first plurality of conductive leads extending from a bottom wall of said first insert and across a top wall of said first insert in a first common plane, thereafter said first plurality of conductive leads forming a first terminal edge by extending toward the rear end of said first insert in a first common oblique plane; and a second plurality of conductive leads extending from said bottom wall of said first insert and across a portion of said top wall of said first insert in a second common plane, and then angularly toward the front end of said first insert in a second common oblique plane having a second terminal edge which extends beyond the first terminal edge; and a second insert, comprising:

a third plurality of conductive leads extending from a bottom of said second insert and across a top wall in third and fourth common planes, thereafter said third plurality of conductive leads forming a third terminal edge by extending toward the rear end of said second insert in a third common oblique plane; and a fourth plurality of conductive leads extending from said bottom of said second insert, across said top wall of said second insert in said fourth common plane, and then angularly toward the front end of said second insert in a fourth common oblique plane to form a fourth terminal edge which extends beyond the third terminal edge, wherein said first and said second oblique planes intersect at a first contact area, and said third and fourth oblique planes intersect at a second contact area.

20. The modular jack connector of claim 19, wherein said second insert is adapted to be mounted on top of said first insert.

21. The modular jack connector of claim 19, wherein each of said first, second, third and fourth pluralities of conductive leads comprise tail sections, said tail sections extending outward of a respective insert for mounting to a printed circuit board.

22. The modular jack connector of claim 19, wherein each of conductive lead of said first, second, third and fourth pluralities of conductive leads have a rectangular cross section.

23. The insulative insert of claim 19, wherein said conductive leads have a first pitch at a front of said insert and a second pitch at a rear of said insert, wherein said first pitch and said second pitch are different.

24. The insulative insert of claim 23, wherein said first pitch is approximately 0.040 inches and said second pitch is approximately 0.050 inches.

25. The insulative insert of claim 19, wherein said conductive leads are plated only in said contact area.

26. An electrical connector, comprising:

a housing having an open interior, a top surface and a front face with an opening in communication with said open interior;

a forwardly facing contact adjacent said front face, said forwardly facing contact having a first portion extending generally parallel to said top portion a first distance in a first plane and a second portion extending generally parallel to said top portion a second distance in a second plane; and a rearwardly facing contact adjacent said front face and having a portion extending generally coplanar to said first portion of said forwardly facing contact a third distance greater than said first distance of said forwardly facing contact.

27. The electrical connector as recited in claim 26, further comprising a second rearwardly facing contact having a portion extending parallel to, but offset from, said first rearwardly facing contact.

28. An electrical connector assembly, comprising:

a housing with an interior section, a front and a rear;

a plurality of first contacts extending through said housing, into said interior section, and directed towards said rear of said housing; and a plurality of second contacts extending through said housing, into said interior section, and directed towards said front of said housing;

wherein said plurality of second contacts includes a first group extending through said housing along a first common plane and a second group extending through said housing along a second common plane different than said first common plane.

29. The electrical connector assembly as recited in claim 28, wherein said plurality of first contacts extend through said housing along a first contact path, said first common plane partially coextensive with said first contact path.

30. The electrical connector assembly as recited in claim 29, wherein said second common plane is not coextensive with said first contact path.

31. The electrical connector assembly as recited in claim 28, wherein said first common plane is partially coextensive with said second common plane.

32. The electrical connector assembly as recited in claim 28, wherein said plurality of first contacts and said plurality of second contacts reside on an insert securable to said housing.

* * * * *

UNITED STATES PATENT AND TRADEMARK OFFICE

CERTIFICATE OF CORRECTION

PATENT NO. : 6,280,256 B1
DATED : August 28, 2001
INVENTOR(S) : Belopolsky et al.

It is certified that error appears in the above-identified patent and that said Letters Patent is hereby corrected as shown below:

Drawings,
Fig. 15, please delete "Figure 56" and insert -- Figure 5C -- therefor;

Column 3,
Line 48, after "members" please insert -- 30 --;
Line 50, after "and" please insert -- 20 --;

Column 4,
Line 59, after "and" please insert -- 5 --;

Column 8,
Line 34, please delete "modularjack" and insert -- modular jack -- therefor;

Column 9,
Line 40, after "thereof" please insert -- . --.

Signed and Sealed this

Fifth Day of November, 2002

*Attest:*

*Attesting Officer*

JAMES E. ROGAN
*Director of the United States Patent and Trademark Office*